US009892687B2

(12) United States Patent
Li

(10) Patent No.: US 9,892,687 B2
(45) Date of Patent: Feb. 13, 2018

(54) ORGANIC LIGHT-EMITTING DIODE (OLED) DISPLAY UNIT

(71) Applicant: SHENZHEN CHINA STAR OPTOELECTRONICS TECHNOLOGY LTD., Guangdong (CN)

(72) Inventor: Hao Li, Guangdong (CN)

(73) Assignee: SHENZHEN CHINA STAR OPTOELECTRONICS TECHNOLOGY CO. LTD., Guangdong (CN)

( * ) Notice: Subject to any disclaimer, the term of this patent is extended or adjusted under 35 U.S.C. 154(b) by 140 days.

(21) Appl. No.: 14/784,584

(22) PCT Filed: Aug. 18, 2015

(86) PCT No.: PCT/CN2015/087375
§ 371 (c)(1),
(2) Date: Oct. 15, 2015

(87) PCT Pub. No.: WO2017/024604
PCT Pub. Date: Feb. 16, 2017

(65) Prior Publication Data

US 2017/0039943 A1 Feb. 9, 2017

(30) Foreign Application Priority Data

Aug. 7, 2015 (CN) ..... 2015 1 0484094

(51) Int. Cl.
*G09G 5/10* (2006.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2310/0289* (2013.01);
(Continued)

(58) Field of Classification Search
CPC ..... G09G 3/3258; G09G 3/3233; G09G 2310/0289; G09G 2330/028; G09G 2320/0233
See application file for complete search history.

(56) References Cited

U.S. PATENT DOCUMENTS 6,204,610 B1 3/2001 Komiya
2003/0030603 A1 2/2003 Shimoda
(Continued)

FOREIGN PATENT DOCUMENTS

CN 1551078 A 12/2004
CN 101510406 A 8/2009
(Continued)

OTHER PUBLICATIONS

Texas Instruments; LMV3xx-N/Q1 Data Sheet—Aug. 2000—Revised Dec. 2014.*

*Primary Examiner* — Ilana Spar
*Assistant Examiner* — Brent D Castiaux
(74) *Attorney, Agent, or Firm* — Mark M. Friedman

(57) ABSTRACT

The present invention provides an organic light-emitting diode (OLED). The OLED comprises a driving circuit having a power module and a regulation unit. The power module is used to input an initial voltage to the power input terminal of pixel-driving unit. The regulation unit regulates the initial voltage, which is outputted from the power input terminal, based on the real voltage of the power input terminal in the pixel-driving unit for equalizing the real voltage of the power input terminal to a predetermined voltage.

19 Claims, 4 Drawing Sheets

(52) U.S. Cl.
CPC ..... *G09G 2320/0233* (2013.01); *G09G 2330/028* (2013.01)

(56) References Cited

U.S. PATENT DOCUMENTS

| | | | | |
|---|---|---|---|---|
| 2003/0107534 | A1 | 6/2003 | Koyama et al. | |
| 2004/0100239 | A1* | 5/2004 | Klotz | H02M 1/15 323/282 |
| 2004/0160168 | A1 | 8/2004 | Lee et al. | |
| 2004/0164949 | A1 | 8/2004 | Koyama et al. | |
| 2007/0278932 | A1 | 12/2007 | Koyama et al. | |
| 2008/0309503 | A1* | 12/2008 | White | G01M 3/26 340/606 |
| 2009/0309503 | A1* | 12/2009 | Kim | G09G 3/3233 315/169.3 |
| 2010/0109717 | A1* | 5/2010 | Lin | G09G 3/3233 327/109 |
| 2010/0194450 | A1 | 8/2010 | Shimizu et al. | |
| 2012/0127065 | A1 | 5/2012 | Koyama et al. | |
| 2014/0285462 | A1* | 9/2014 | Lee | G09G 3/3648 345/173 |
| 2014/0333518 | A1 | 11/2014 | Zhang et al. | |
| 2015/0310807 | A1 | 10/2015 | Sun et al. | |

FOREIGN PATENT DOCUMENTS

| | | | |
|---|---|---|---|
| CN | 101861615 | A | 10/2010 |
| CN | 102214440 | A | 10/2011 |
| CN | 103295536 | A | 9/2013 |
| CN | 103383835 | A | 11/2013 |
| JP | 2002202756 | A | 7/2002 |

* cited by examiner

ORGANIC LIGHT-EMITTING DIODE (OLED) DISPLAY UNIT

BACKGROUND OF THE INVENTION

Field of Invention

The present invention relates to a technical field of a display unit, and more particularly to an organic light-emitting diode (OLED) display unit.

Description of Prior Art

An organic light-emitting diode (OLED) display with self-illuminated characteristic has a wide viewing angle and a power-saving and thus is widely applicable to mobile phones and television sets.

The OLED display comprises a plurality of OLEDs which are driven by a driving circuit when a voltage (e.g. OVDD) level is inputted to the driving circuit. However, since a driving loading easily makes an effect on the driving circuit so that the real voltage exerted on the OLEDs fluctuates irregularly, which disadvantageously downgrades the uniformity of the display unit and reduces the display effect.

Consequently, there is a need to develop an organic light-emitting diode (OLED) display to solve the problems of the conventional technique.

SUMMARY OF THE INVENTION

One objective of the present invention is to provide organic light-emitting diode (OLED) display unit to solve the technical problems of the irregular fluctuation of the real voltage on the OLED due to the driving loading effect, which disadvantageously downgrades the uniformity of the display unit.

To solve the above-mentioned problems, the present invention sets forth an OLED display unit, comprising: a first substrate comprising: a plurality of data lines, for being inputted by data signals; a plurality of scanning lines, for being inputted by scanning signals; a plurality of organic light-emitting units, for being defined and enclosed by the data lines and the scanning lines wherein the organic light-emitting unit comprises an OLED; and a plurality of pixel-driving units, each of the organic light-emitting units being corresponded to one pixel-driving unit wherein the pixel-driving unit connected to the OLED comprises a power input terminal and an illumination control terminal; the pixel-driving unit controls a display status of the OLED based on the data signals, the scanning signals and a voltage inputted to the power input terminal; and the illumination control terminal is inputted by an illumination control signal for controlling whether the OLED illuminates or not;

a second substrate disposed to the first substrate oppositely; and a driving circuit, comprising: a power module, for being used to input an initial voltage to the power input terminal wherein the power module comprises a first output terminal for inputting an initial voltage to the power input terminal; and a regulation unit, for regulating the initial voltage, which is outputted from the power input terminal, based on a real voltage of the power input terminal in the pixel-driving unit for equalizing the real voltage of the power input terminal to a predetermined voltage; wherein the regulation unit comprises a first input terminal, a second input terminal and a second output terminal; the first input terminal is inputted by the initial voltage of the power module; and the second input terminal is inputted by the real voltage of the power input terminal; the second output terminal outputs a feedback voltage to the first output terminal; and wherein the first output terminal is connected to the first input terminal, the second input terminal is connected to the power input terminal, and the second output terminal is connected to the first output terminal.

In the OLED display unit, the regulation unit is used to decrease a voltage of the first output terminal when the real voltage of the power input terminal increases.

In the OLED display unit, the regulation unit is used to increase the voltage of the first output terminal when the real voltage of the power input terminal decreases.

In the OLED display unit, the regulation unit comprises: a blocking sub-unit, for being used to block the real voltage of the power input terminal, which is inputted to the second input terminal, for generating an alternating regulation voltage; and a feedback sub-unit, for feedbacking and regulating the initial voltage of the power module based on the alternating regulation voltage for generating a feedback voltage.

In the OLED display unit, when the alternating feedback voltage is greater than the predetermined voltage, the feedback sub-unit acquires a negative feedback voltage based on the alternating regulation voltage and the initial voltage of the power module for decreasing the voltage of the first output terminal.

In the OLED display unit, when the alternating feedback voltage is less than the predetermined voltage, the feedback sub-unit acquires a positive feedback voltage based on the alternating regulation voltage and the initial voltage of the power module for increasing the voltage of the first output terminal.

In the OLED display unit, the feedback voltage is a difference value between the initial voltage of the power module and the alternating feedback voltage.

In the OLED display unit, the regulation unit comprises a first resistance, a second resistance, a third resistance, a fourth resistance, a differential amplifier and a first capacitor, and the differential amplifier comprises an original input terminal, a feedback input terminal and a differential output terminal;

wherein the first input terminal is connected to the original input terminal by way of the first resistance;

wherein the second input terminal is connected to one terminal of the first capacitor, the other terminal of the first capacitor is connected to one terminal of the third resistance, and the other terminal of the third resistance is connected to the feedback input terminal; and wherein the second output terminal is connected to the differential output terminal, the fourth resistance is connected between the feedback input terminal and the differential output terminal, and the original input terminal is grounded by way of the second resistance.

In the OLED display unit, the pixel-driving unit comprises a first switch transistor, a second switch transistor, a third switch transistor and a second capacitor;

wherein the control terminal of the first switch transistor is connected to the scanning line and the input terminal of the first switch transistor is connected to data line;

wherein the control terminal of the third switch transistor is connected to the illumination control terminal, the input terminal of the third switch transistor is connected to the power input terminal, and the output terminal of the third switch transistor is connected to the input terminal of the second switch transistor;

wherein the control terminal of the second switch transistor is connected to the output terminal of the first switch transistor, the output terminal of the second switch transistor is connected to an anode of the OLED, and the anode of the OLED is connected to the low voltage level with direct current;

wherein the output terminal of the first switch transistor is connected to the input terminal of the second switch transistor by way of the second capacitor.

To solve the above-mentioned problems, the present invention sets forth an OLED display unit, comprising:

a first substrate comprising: a plurality of data lines, for being inputted by data signals; a plurality of scanning lines, for being inputted by scanning signals; a plurality of organic light-emitting units, for being defined and enclosed by the data lines and the scanning lines wherein the organic light-emitting unit comprises an OLED; and a plurality of pixel-driving units, each of the organic light-emitting units being corresponded to one pixel-driving unit wherein the pixel-driving unit connected to the OLED comprises a power input terminal; the pixel-driving unit controls a display status of the OLED based on the data signals, the scanning signals and a voltage inputted to the power input terminal;

a second substrate disposed to the first substrate oppositely; and a driving circuit, comprising: a power module, for being used to input an initial voltage to the power input terminal; and a regulation unit, for regulating the initial voltage, which is outputted from the power input terminal, based on a real voltage of the power input terminal in the pixel-driving unit for equalizing the real voltage of the power input terminal to a predetermined voltage.

In the OLED display unit, the power module comprises a first output terminal for inputting an initial voltage to the power input terminal;

wherein the regulation unit comprises a first input terminal, a second input terminal and a second output terminal; the first input terminal is inputted by the initial voltage of the power module; and the second input terminal is inputted by the real voltage of the power input terminal; the second output terminal outputs a feedback voltage to the first output terminal; and wherein the first output terminal is connected to the first input terminal, the second input terminal is connected to the power input terminal, and the second output terminal is connected to the first output terminal.

In the OLED display unit, the regulation unit is used to decrease a voltage of the first output terminal when the real voltage of the power input terminal increases.

In the OLED display unit, the regulation unit is used to increase the voltage of the first output terminal when the real voltage of the power input terminal decreases.

In the OLED display unit, the regulation unit comprises: a blocking sub-unit, for being used to block the real voltage of the power input terminal, which is inputted to the second input terminal, for generating an alternating regulation voltage; and a feedback sub-unit, for feedbacking and regulating the initial voltage of the power module based on the alternating regulation voltage for generating a feedback voltage.

In the OLED display unit, when the alternating feedback voltage is greater than the predetermined voltage, the feedback sub-unit acquires a negative feedback voltage based on the alternating regulation voltage and the initial voltage of the power module for decreasing the voltage of the first output terminal.

In the OLED display unit, when the alternating feedback voltage is less than the predetermined voltage, the feedback sub-unit acquires a positive feedback voltage based on the alternating regulation voltage and the initial voltage of the power module for increasing the voltage of the first output terminal.

In the OLED display unit, the feedback voltage is a difference value between the initial voltage of the power module and the alternating feedback voltage.

In the OLED display unit, the regulation unit comprises a first resistance, a second resistance, a third resistance, a fourth resistance, a differential amplifier and a first capacitor, and the differential amplifier comprises an original input terminal, a feedback input terminal and a differential output terminal;

wherein the first input terminal is connected to the original input terminal by way of the first resistance;

wherein the second input terminal is connected to one terminal of the first capacitor, the other terminal of the first capacitor is connected to one terminal of the third resistance, and the other terminal of the third resistance is connected to the feedback input terminal; and wherein the second output terminal is connected to the differential output terminal, the fourth resistance is connected between the feedback input terminal and the differential output terminal, and the original input terminal is grounded by way of the second resistance.

In the OLED display unit, the pixel-driving unit further comprises an illumination control terminal which is inputted by an illumination control signal for controlling whether the OLED illuminates or not, and the pixel-driving unit further comprises: a first switch transistor, a second switch transistor, a third switch transistor and a second capacitor;

wherein the control terminal of the first switch transistor is connected to the scanning line and the input terminal of the first switch transistor is connected to data line;

wherein the control terminal of the third switch transistor is connected to the illumination control terminal, the input terminal of the third switch transistor is connected to the power input terminal, and the output terminal of the third switch transistor is connected to the input terminal of the second switch transistor;

wherein the control terminal of the second switch transistor is connected to the output terminal of the first switch transistor, the output terminal of the second switch transistor is connected to an anode of the OLED, and the anode of the OLED is connected to the low voltage level with direct current;

wherein the output terminal of the first switch transistor is connected to the input terminal of the second switch transistor by way of the second capacitor.

DETAILED DESCRIPTION OF THE PREFERRED EMBODIMENTS

Figure 1:
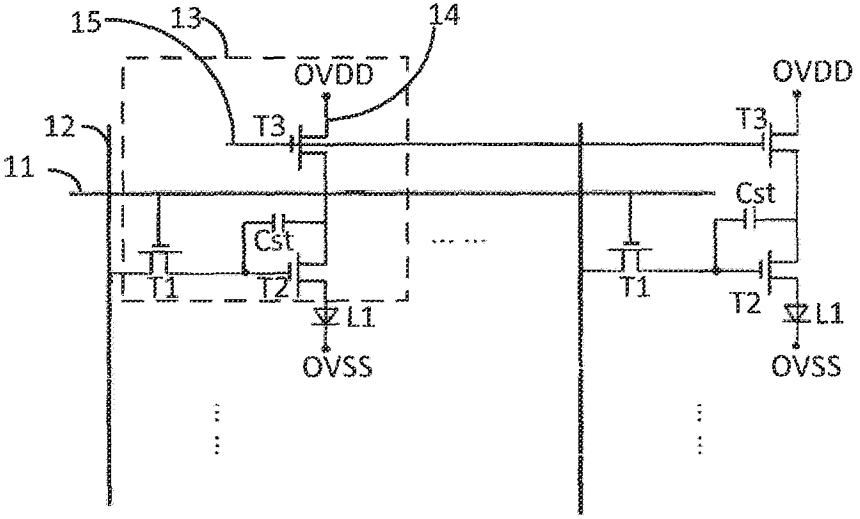
FIG. 1 is a schematic circuit view of a pixel driving unit according to one embodiment of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

Please refer to FIG. 1, which is a schematic circuit view of a pixel driving unit according to one embodiment of the present invention.

The organic light-emitting diode (OLED) display unit in the present invention comprises a first substrate, a second substrate disposed to the first substrate oppositely, and a driving a circuit. As shown in FIG. 1, the first substrate comprises a plurality of data lines 12, a plurality of scanning lines 11, a plurality of organic light-emitting units, and a plurality of pixel-driving units 13. The data lines 12 are used to input the data signals. The scanning lines 11 are used to input the scanning signals. The organic light-emitting units are defined and enclosed by the data lines 12 and the scanning lines 11 wherein the organic light-emitting units comprise OLEDs L1.

Each of the organic light-emitting units corresponds to one pixel-driving unit 13 wherein the pixel-driving unit 13 comprises a power input terminal 14 and the pixel-driving unit 13 connects to the OLED L1. The pixel-driving unit 13 controls the display status of the OLED L1 based on the data signal, the scanning signal and the voltage (e.g. OVDD) inputted to the power input terminal 14.

The driving circuit comprises a power module and a regulation unit.

The power module is used to input an initial voltage to the power input terminal 14. The regulation unit regulates the initial voltage, which is outputted from the power input terminal 14, based on the real voltage of the power input terminal 14 in the pixel-driving unit 13 so that the real voltage of the power input terminal 14 is equal to a predetermined voltage.

The pixel-driving unit 13 further comprises an illumination control terminal 15 wherein the illumination control terminal 15 is inputted by an illumination control signal for controlling whether the OLED illuminates or not. When the illumination control signal is in high level, the OLED illuminates and when the illumination control signal is in low level, the OLED does not illuminate.

Figure 2:
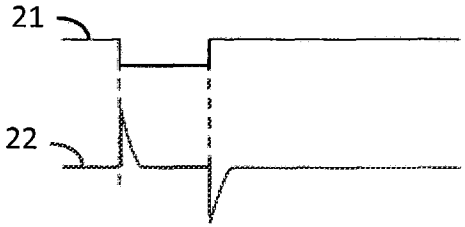
FIG. 2 is a schematic waveform view of the driving voltage fluctuation of the conventional OLED.

As shown in FIG. 2, the waveform of the illumination control signal is indicated by the numeral 21 in FIG. 2 and the real voltage of the power input terminal 14 is indicated by the numeral 22 in FIG. 2. When the voltage of illumination control signal changes from high to low or from low to high, the real voltage 22 of the power input terminal 14 induces the positive pulse and negative pulse due to the resistance fluctuation of the loading. The positive pulse and negative pulse disadvantageously affects the driving circuit of the OLED and further downgrades the uniformity.

The pixel-driving unit 13 comprises a first switch transistor T1, a second switch transistor T2, a third switch transistor T3 and a second capacitor Cst.

The control terminal of the first switch transistor T1 is connected to the scanning line 11 and the input terminal of the first switch transistor T1 is connected to data line 12. The control terminal of the third switch transistor T3 is connected to the illumination control terminal 15, the input terminal of the third switch transistor T3 is connected to the power input terminal 14, and the output terminal of the third switch transistor T3 is connected to the input terminal of the second switch transistor T2.

The control terminal of the second switch transistor T2 is connected to the output terminal of the first switch transistor T1. The output terminal of the second switch transistor T2 is connected to the anode of the OLED L1 wherein the anode of the OLED L1 is connected to the low voltage level (e.g. OVSS) with direct current. The output terminal of the first switch transistor T1 is connected to the input terminal of the second switch transistor T2 by way of the second capacitor Cst.

Preferably, the power module comprises a first output terminal wherein the first output terminal inputs an initial voltage to the power input terminal 14. The regulation unit comprises a first input terminal 23, a second input terminal 24 and a second output terminal 25. The first input terminal 23 is inputted by the initial voltage of the power module. The second input terminal 24 is inputted by the real voltage of the power input terminal 14. The second output terminal 25 outputs a feedback voltage to the first output terminal.

The first output terminal is connected to the first input terminal 23, the second input terminal 24 is connected to the power input terminal 14, and the second output terminal 25 is also connected to the first output terminal.

Preferably, the regulation unit is used to decrease the voltage of the first output terminal when the real voltage of the power input terminal 14 increases. Furthermore, the regulation unit is used to increase the voltage of the first output terminal when the real voltage of the power input terminal 14 decreases.

Preferably, the regulation unit comprises a blocking sub-unit and a feedback sub-unit.

The blocking sub-unit is used to block the real voltage of the power input terminal 14, which is inputted to the second input terminal 24, for generating an alternating regulation voltage. In other words, the component of the direct current is filtered and the rest of alternating current component is inputted to the feedback sub-unit. Preferably, the blocking sub-unit is a capacitor. The feedback sub-unit feedbacks and regulates the initial voltage of the power module based on the alternating regulation voltage for generating a feedback voltage. In one embodiment, the feedback sub-unit is a differential amplifier.

Figure 4:
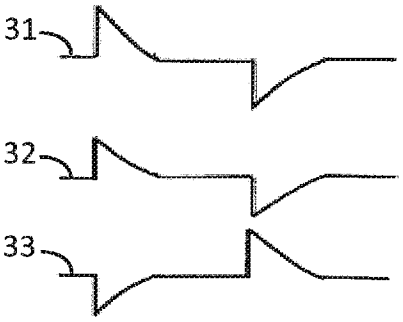
FIG. 4 is a schematic circuit view of regulating the voltage of the regulation unit according to one embodiment of the present invention.

For example, the detecting module detects the real voltage of the power input terminal 14. As shown in FIG. 4, the real voltage 31 of the power input terminal 14 is composed of direct current component and alternating current component. In one case, the voltage with direct current is 10V (voltage) to be inputted to the second input terminal 24. The real voltage 31 is processed by the blocking sub-unit to form the high frequency pulse signal 32 (only the alternating current component remaining with the voltage basis 0V). Meanwhile, the high frequency pulse signal 32 with the alternating current component is inputted to the regulation sub-unit. The regulation sub-unit processes the alternating current component and initial voltage of the power module to form a compensation signal 33 (i.e. the feedback voltage) and the compensation signal 33 is outputted to the first input terminal so that the real voltage of the power input terminal maintains constant.

Figure 3:
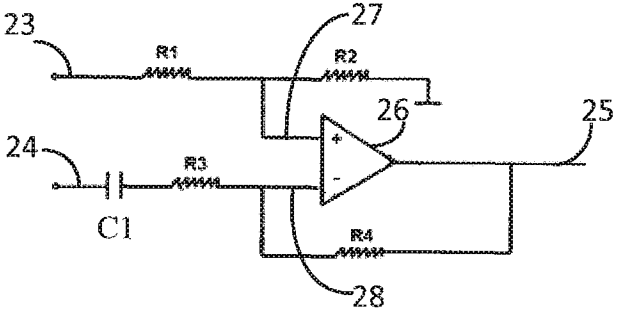
FIG. 3 is a schematic circuit view of a regulation unit disposed in the driving circuit according to one embodiment of the present invention.

Preferably, as shown in FIG. 3, the regulation unit comprises a first resistance R1, a second resistance R2, a third resistance R3, a fourth resistance R4, a differential amplifier 26 and a first capacitor C1 wherein the differential amplifier 26 has an original input terminal 27, a feedback input terminal 28 and a differential output terminal.

The first input terminal 23 is connected to the original input terminal 27 by way of the first resistance R1.

The second input terminal 24 is connected to one terminal of the first capacitor C1, the other terminal of the first capacitor C1 is connected to one terminal of the third resistance R3, and the other terminal of the third resistance R3 is connected to the feedback input terminal 28.

The second output terminal 25 is connected to the differential output terminal, the fourth resistance R4 is connected between the feedback input terminal 28 and the differential output terminal, and the original input terminal 27 is grounded by way of the second resistance R2. Preferably, the resistance ratio between the first resistance R1 and the second resistance R2 is one.

Preferably, when the alternating feedback voltage is greater than the predetermined voltage, the feedback sub-unit acquires a negative feedback voltage based on the alternating regulation voltage and the initial voltage of the power module for decreasing the voltage of the first output terminal.

For an example of predetermined voltage 2V, when the alternating feedback voltage is 12V, the differential output terminal of the differential amplifier is −2V and the feedback voltage −2V is inputted to the first output terminal of the power module so that the real voltage of the power input terminal is equal to 10V.

Preferably, when the alternating feedback voltage is less than the predetermined voltage, the feedback sub-unit acquires a positive feedback voltage based on the alternating regulation voltage and the initial voltage of the power module for increasing the voltage of the first output terminal.

For an example of predetermined voltage 2V, when the alternating feedback voltage is 8V, the differential output terminal of the differential amplifier is 2V and the feedback voltage 2V is inputted to the first output terminal of the power module so that the real voltage of the power input terminal is equal to 10V.

Preferably, the feedback voltage is the difference value between the initial voltage of the power module and the alternating feedback voltage.

The OLED display unit in the present invention adds a voltage regulation unit to the conventional driving circuit and regulates the voltage inputted to the OLED in real-time to avoid the driving voltage fluctuation so as to upgrade the uniformity of the display unit and increase the display effect.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. An organic light-emitting diode (OLED) display unit, comprising:

a first substrate comprising:

a plurality of data lines, for being inputted by data signals;

a plurality of scanning lines, for being inputted by scanning signals;

a plurality of organic light-emitting units, for being defined and enclosed by the data lines and the scanning lines wherein the organic light-emitting unit comprises an OLED; and a plurality of pixel-driving units, each of the organic light-emitting units being corresponded to one pixel-driving unit wherein the pixel-driving unit connected to the OLED comprises a power input terminal and an illumination control terminal; the pixel-driving unit controls a display status of the OLED based on the data signals, the scanning signals and a voltage inputted to the power input terminal; and the illumination control terminal is inputted by an illumination control signal for controlling whether the OLED illuminates or not, wherein the pixel-driving unit comprises a first switch transistor, a second switch transistor, a third switch transistor, and a second capacitor, wherein the power input terminal and the second capacitor are connected directly by the third switch transistor; wherein the input terminal of the third switch transistor is only directly connected to the power input terminal, and the output terminal of the third switch transistor is only directly connected to the input terminal of the second switch transistor and the second capacitor;

a second substrate disposed to the first substrate oppositely; and a driving circuit, comprising:

a power module, for being used to input an initial voltage to the power input terminal wherein the power module comprises a first output terminal for inputting an initial voltage to the power input terminal; and a regulation unit, for regulating the initial voltage, which is outputted from the power input terminal, based on a real voltage of the power input terminal in the pixel-driving unit for equalizing the real voltage of the power input terminal to a predetermined voltage;

wherein the regulation unit comprises a first input terminal, a second input terminal and a second output terminal; the first input terminal is inputted by the initial voltage of the power module; and the second input terminal is inputted by the real voltage of the power input terminal; the second output terminal outputs a feedback voltage to the first output terminal; wherein the regulation unit comprises a first resistance and a second resistance, a resistance ratio between the first resistance and the second resistance is one; and wherein the first output terminal is connected to the first input terminal, the second input terminal is connected to the power input terminal, and the second output terminal is connected to the first output terminal.

2. The OLED display unit of claim 1, wherein the regulation unit is used to decrease a voltage of the first output terminal when the real voltage of the power input terminal increases.

3. The OLED display unit of claim 2, wherein the regulation unit is used to increase the voltage of the first output terminal when the real voltage of the power input terminal decreases.

4. The OLED display unit of claim 1, wherein the regulation unit comprises:

a blocking sub-unit, for being used to block the real voltage of the power input terminal, which is inputted to the second input terminal, for generating an alternating regulation voltage; and a feedback sub-unit, for feedbacking and regulating the initial voltage of the power module based on the alternating regulation voltage for generating a feedback voltage.

5. The OLED display unit of claim 4, wherein when the alternating feedback voltage is greater than the predetermined voltage, the feedback, sub-unit acquires a negative feedback voltage based on the alternating regulation voltage and the initial voltage of the power module for decreasing the voltage of the first output terminal.

6. The OLED display unit of claim 4, wherein when the alternating feedback voltage is less than the predetermined voltage, the feedback sub-unit acquires a positive feedback voltage based on the alternating regulation voltage and the initial voltage of the power module for increasing the voltage of the first output terminal.

7. The OLED display unit of claim 4, wherein the feedback voltage is a difference value between the initial voltage of the power module and the alternating feedback voltage.

8. The OLED display unit of claim 1, wherein the regulation unit comprises a third resistance, a fourth resistance, a differential amplifier, and a first capacitor, and the differential amplifier comprises an original input terminal, a feedback input terminal and a differential output terminal;

wherein the first input terminal is connected to the original input terminal by way of the first resistance;

wherein the second input terminal is connected to one terminal of the first capacitor, the other terminal of the first capacitor is connected to one terminal of the third resistance, and the other terminal of the third resistance is connected to the feedback input terminal; and wherein the second output terminal is connected to the differential output terminal, the fourth resistance is connected between the feedback input terminal and the differential output terminal, and the original input terminal is grounded by way of the second resistance.

9. The OLED display unit of claim 1, wherein the control terminal of the first switch transistor is connected to the scanning line and the input terminal of the first switch transistor is connected to data line;

wherein the control terminal of the third switch transistor is connected to the illumination control terminal;

wherein the control terminal of the second switch transistor is connected to the output terminal of the first switch transistor, the output terminal of the second switch transistor is connected to an anode of the OLED, and the anode of the OLED is connected to the low voltage level with direct current;

wherein the output terminal of the first switch transistor is connected to the input terminal of the second switch transistor by way of the second capacitor.

10. An organic light-emitting diode (OLED) display unit, comprising:

a first substrate comprising:

a plurality of data lines, for being inputted by data signals;

a plurality of scanning lines, for being inputted by scanning signals;

a plurality of organic light-emitting units, for being defined and enclosed by the data lines and the scanning lines wherein the organic light-emitting unit comprises an OLED; and a plurality of pixel-driving units, each of the organic light-emitting units being corresponded to one pixel-driving unit wherein the pixel-driving unit connected to the OLED comprises a power input terminal; the pixel-driving unit controls a display status of the OLED based on the data signals, the scanning signals and a voltage inputted to the power input terminal, wherein the pixel-driving unit comprises a first switch transistor, a second switch transistor, a third switch transistor, and a second capacitor; wherein the power input terminal and the second capacitor are connected directly by the third switch transistor; wherein the input terminal of the third switch transistor is only directly connected to the power input terminal, and the output terminal of the third switch transistor is only directly connected to the input terminal of the second switch transistor and the second capacitor;

a second substrate disposed to the first substrate oppositely; and a driving circuit, comprising:

a power module, for being used to input an initial voltage to the power input terminal; and a regulation unit, for regulating the initial voltage, which is outputted from the power input terminal, based on a real voltage of the power input terminal in the pixel-driving unit for equalizing the real voltage of the power input terminal to a predetermined voltage, wherein the regulation unit comprises a first resistance and a second resistance, a resistance ratio between the first resistance and the second resistance is one.

11. The OLED display unit of claim 10, wherein the power module comprises a first output terminal for inputting an initial voltage to the power input terminal;

wherein the regulation unit comprises a first input terminal, a second input terminal and a second output terminal; the first input terminal is inputted by the initial voltage of the power module; and the second input terminal is inputted by the real voltage of the power input terminal; the second output terminal outputs a feedback voltage to the first output terminal; and wherein the first output terminal is connected to the first input terminal, the second input terminal is connected to the power input terminal, and the second output terminal is connected to the first output terminal.

12. The OLED display unit of claim 11, wherein the regulation unit is used to decrease a voltage of the first output terminal when the real voltage of the power input terminal increases.

13. The OLED display unit of claim 12, wherein the regulation unit is used to increase the voltage of the first output terminal when the real voltage of the power input terminal decreases.

14. The OLED display unit of claim 11, wherein the regulation unit comprises:

a blocking sub-unit, for being used to block the real voltage of the power input terminal, which is inputted to the second input terminal, for generating an alternating regulation voltage; and a feedback sub-unit, for feedbacking and regulating the initial voltage of the power module based on the alternating regulation voltage for generating a feedback voltage.

15. The OLED display unit of claim 14, wherein when the alternating feedback voltage is greater than the predetermined voltage, the feedback sub-unit acquires a negative feedback voltage based on the alternating regulation voltage and the initial voltage of the power module for decreasing the voltage of the first output terminal.

16. The OLED display unit of claim 14, wherein when the alternating feedback voltage is less than the predetermined voltage, the feedback sub-unit acquires a positive feedback voltage based on the alternating regulation voltage and the initial voltage of the power module for increasing the voltage of the first output terminal.

17. The OLED display unit of claim 14, wherein the feedback voltage is a difference value between the initial voltage of the power module and the alternating feedback voltage.

18. The OLED display unit of claim 11, wherein the regulation unit comprises a third resistance, a fourth resistance, a differential amplifier, and a first capacitor, and the differential amplifier comprises an original input terminal, a feedback input terminal and a differential output terminal;

wherein the first input terminal is, connected to the original input terminal by way of the first resistance;

wherein the second input terminal is connected to one terminal of the first capacitor, the other terminal of the first capacitor is connected to one terminal of the third resistance, and the other terminal of the third resistance is connected to the feedback input terminal; and wherein the second output terminal is connected to the differential output terminal, the fourth resistance is connected between the feedback input terminal and the differential output terminal, and the original input terminal is grounded by way of the second resistance.

19. The OLED display unit of claim 10, wherein the pixel-driving unit further comprises an illumination control terminal which is inputted by an illumination control signal for controlling whether the OLED illuminates or not;

wherein the control terminal of the first switch transistor is connected to the scanning line and the input terminal of the first switch transistor is connected to data line;

wherein the control terminal of the third switch transistor is connected to the illumination control terminal;

wherein the control terminal of the second switch transistor is connected to the output terminal of the first switch transistor, the output terminal of the second switch transistor is connected to an anode of the OLED, and the anode of the OLED is connected to the low voltage level with direct current;

wherein the output terminal of the first switch transistor is connected to the input terminal of the second switch transistor by way of the second capacitor.

* * * * *